US011040860B2

(12) United States Patent
Konijn

(10) Patent No.: US 11,040,860 B2
(45) Date of Patent: Jun. 22, 2021

(54) CRANE HAVING A COLLAPSIBLE JIB

(71) Applicant: Liebherr-Werk Biberach GmbH, Biberach an der Riss (DE)

(72) Inventor: Eric Konijn, Singapore (SG)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 72 days.

(21) Appl. No.: 16/468,757

(22) PCT Filed: Dec. 21, 2017

(86) PCT No.: PCT/EP2017/084069
§ 371 (c)(1),
(2) Date: Jun. 12, 2019

(87) PCT Pub. No.: WO2018/115271
PCT Pub. Date: Jun. 28, 2018

(65) Prior Publication Data

US 2019/0315603 A1 Oct. 17, 2019

(30) Foreign Application Priority Data

Dec. 22, 2016 (DE) ..... 10 2016 015 385.7

(51) Int. Cl.
*B66C 23/26* (2006.01)
*B66C 23/68* (2006.01)
*B66C 23/92* (2006.01)

(52) U.S. Cl.
CPC ..... *B66C 23/26* (2013.01); *B66C 23/68* (2013.01); *B66C 23/92* (2013.01)

(58) Field of Classification Search
CPC ..... B66C 23/16; B66C 23/26; B66C 23/68; B66C 23/92; B66C 23/94; B66C 23/342
See application file for complete search history.

(56) References Cited

U.S. PATENT DOCUMENTS

| | | | | |
|---|---|---|---|---|
| 3,596,772 | A * | 8/1971 | Pingon | B66C 23/26 212/295 |
| 3,804,264 | A * | 4/1974 | Hedeen | B66C 23/26 212/295 |
| 4,529,094 | A | 7/1985 | Wadsworth | |
| 4,596,336 | A * | 6/1986 | Zwagerman | B66C 23/701 212/296 |
| 6,290,078 | B1 * | 9/2001 | Verchere | B66C 23/26 212/300 |
| 2016/0083229 | A1 * | 3/2016 | Assfalg | B66C 13/18 212/257 |
| 2017/0183203 | A1 * | 6/2017 | Verchere | B66C 23/342 |
| 2019/0106305 | A1 * | 4/2019 | Raymond | B66C 23/92 |

FOREIGN PATENT DOCUMENTS

| | | |
|---|---|---|
| CN | 203 820 334 U | 9/2014 |
| CN | 105 271 024 A | 1/2016 |
| CN | 105 293 300 A | 2/2016 |
| CN | 105 293 321 A | 2/2016 |
| DE | 21 01 841 B2 | 2/1973 |

(Continued)

*Primary Examiner* — Emmanuel M Marcelo
(74) *Attorney, Agent, or Firm* — Dilworth & Barrese, LLP

(57) ABSTRACT

The invention relates to a crane comprising a tower and a jib, wherein the jib rests on the tower and is fixed on the tower when the crane is in an inoperative position.

16 Claims, 3 Drawing Sheets

(56) References Cited

FOREIGN PATENT DOCUMENTS

| | | | | | |
|---|---|---|---|---|---|
| DE | 34 30 747 | A1 | | 3/1985 | |
| DE | 3441573 | A1 | * | 5/1986 | ..... B66C 23/26 |
| DE | 102012018111 | A1 | * | 3/2014 | ..... B66C 23/342 |
| EP | 1398291 | A1 | * | 3/2004 | ..... B66C 23/342 |
| FR | 2457241 | A3 | * | 12/1980 | ..... B66C 23/342 |
| GB | 1 005 003 | A | | 9/1965 | |

* cited by examiner

CRANE HAVING A COLLAPSIBLE JIB

Background of the Invention

The invention relates to a crane comprising a tower and a jib, wherein the jib rests on the tower and is fixed on the tower when the crane is in an inoperative position.

In the case of jib cranes known from the prior art, comprising adjustable jibs, when inoperative said jibs can be set into a secure position, in which the crane can rotate freely for example. This means that, in the event of a corresponding wind load the crane jib or the wind can rotate the jib in the particular wind direction. In this situation, the wind pushes on the crane from the rear, i.e. from the counter ballast side or from the side opposite the jib, and the position assumed by the crane substantially corresponds to the position shown in FIG. 1. In this figure, the wind can accordingly act on the crane from the left-hand side.

It is furthermore known to also use more than one crane, for example on a construction site, wherein the mutual spacing between the cranes may be so small that it is possible that the cranes can no longer rotate freely without colliding with one another or with other structures. For example, cranes that are located too close to other structures can no longer rotate freely.

For this reason, it is known from the prior art to orient the jib of the crane so as to point as steeply as possible upwards, as a result of which, although the turning circle of the crane is reduced in the inoperative position, at the same time the wind attack surface of the crane in the horizontal direction is increased. Furthermore, this solution impairs the equilibrium of the crane, with the result that cranes that are set accordingly are no longer sufficiently freely rotatable. This may in turn lead to accidents or to damage to the crane.

SUMMARY OF THE INVENTION

Against this background, the object of the invention is that of providing an improved crane which can in particular be set into a more secure and more stable inoperative position. In an inoperative position, a crane according to the invention can no longer easily collide with other cranes or further structures, and the jib of the crane can no longer be pushed over the crane, or towards the rear, as a result of storm loading from the front, i.e. from the direction of the jib. It is furthermore possible, in the case of cranes designed according to the invention, to achieve greater free-standing tower heights.

The object is achieved according to the invention by a crane having the features herein of claim 1. The dependent claims relate to advantageous embodiments. According thereto, a crane, in particular a revolving tower crane, is provided, comprising a tower and a jib, wherein the jib rests on the tower and is fixed on the tower when the crane is in an inoperative position. In this case, the jib may rest directly or indirectly on the tower. In the present case, the inoperative position means a position of the crane in which said crane can be fixed securely and permanently, in order, for example to be able to better withstand the force effects brought about by high winds. The inoperative position is thus explicitly not a position of the crane that can be assumed in the short term, such as an installation position which can be assumed when erecting or dismantling the crane, and which is not a permanently stable position. This is clear from the statement that the jib is fixed on the tower in the inoperative position.

Fixing according to the invention means that, in addition to the conventional articulation point between the jib and the tower, a further physical connection between the tower and the jib is provided, which connection prevents pivoting of the tower relative to the jib about the conventional first articulation point. The fixing according to the invention furthermore prevents a relative movement between the tower and the jib that is oriented perpendicularly to the first movement, or fixes the jib and tower relative to one another such that, in the event of a force effect on the jib, said jib can be fixed, together with the tower, with respect to a vertical axis of rotation of the two. The statement that the tower rests directly or indirectly on the jib, or vice versa, means that the tower and jib may be in direct contact with one another or may be in indirect contact with one another via a further component, such as a frame that can be coupled to the tower.

In the inoperative position according to the invention, the jib may be lowered completely, as far as the tower, and/or may be locked or fixed to the tower. It is conceivable that, in this position, the rotatable part of the crane or the otherwise rotatable tower or a rotatable transmission platform may no longer be rotatable. The crane can thus be designed to withstand wind loads from any directions, in particular horizontal directions, and to thus be retained in a secure and stable manner in the inoperative position.

In a preferred embodiment, it is conceivable that, in the inoperative position, the jib may rest on the tower so as to be parallel or substantially parallel. As a result, the jib can be arranged on the tower in a particularly space-saving manner, and the turning circle thereof and/or the dimensions thereof in the radial direction can be accordingly minimized in the inoperative position. Furthermore, in the event of a parallel orientation of the tower and of the jib it is particularly easy to couple said parts together and thus to fix them. In this case, the parallel orientation does not have to mean an exactly parallel orientation, and deviations between the tower and the jib of up to 20°, in particular up to 10°, and more particularly up to 5° are also covered by the inventive concept. The resting of the jib can thus relate to an orientation in which the angle spanned by the jib and by the tower is less than 20°.

In a further preferred embodiment, it is conceivable that, in the inoperative position, the jib may be coupled to the tower by means of a frame. In this case, the frame may be provided permanently on the tower or, depending on the requirements, may be stored separately from the tower and attached to the tower in order to bring the crane into the inoperative position. In this case, the frame may comprise a portion having a profile that is the same as or similar to that of the tower. In the case of towers having a rectangular cross section, the frame may for example also have a corresponding rectangular cross section but one that is larger than the cross section of the tower. The frame can thus be positioned around the tower, entirely or in part, and can particularly effectively introduce forces or torques from the jib into the tower. It is also conceivable to form the frame as a simple connection element between the tower and the jib, which element, as a second articulation point between the tower and jib, prevents a relative movement between said two components.

In a further preferred embodiment, it is conceivable for an auxiliary support to be provided between a jib retaining support and an adjustment winder for adjusting the jib, which auxiliary support is coupled to the jib retaining support, by means of at least one guy rod, when in a working position. The auxiliary support may be used to keep a guy rope, which is guided over the guy rod, away from or spaced apart from further apparatuses of the crane, in particular in the inoperative position of the crane, and thus to allow for or simplify the adjustment of the crane between the respective positions thereof.

In a further preferred embodiment, it is furthermore conceivable for the auxiliary support and the jib retaining support to be uncoupled from one another in the inoperative position. In contrast, in a working position of the crane, the auxiliary support and the jib retaining support may be retained so as to be at an in particular constant mutual spacing, by means of a cylinder.

In a further preferred embodiment, it is conceivable that, in an installation position, the jib may be coupled to a transmission platform, by means of a stay, at a jib articulation part. In this case, the stay may be detachably arranged on the jib articulation part and/or on the transmission platform, and may support the jib alone, i.e. without tensioning the adjustment rope or using other support structures, in the installation position. As a result, apparatuses belonging to the adjustment rope may be adjusted or changed; for example the auxiliary support may be uncoupled from the jib retaining support, which components may be coupled to one another by means of the now relaxed adjustment rope.

In a particularly preferred embodiment, it is conceivable that, in the inoperative position, the stay may be uncoupled from the jib articulation part and/or from the transmission platform. The stay prevents the jib from pivoting downwards and must accordingly be uncoupled at least from one of the two components of the jib articulation part or transmission platform, in order to pivot the jib downwards.

In a further preferred embodiment, it is conceivable for the jib articulation part to be hinged, wherein a front part and a rear part of the jib articulation part are rotatably coupled together by means of a pivot point. This two-part design of the jib articulation part makes it possible to fold the further parts of the jib, which are coupled to the jib articulation part, downwards by 90° or by more or by less, without a collision occurring between the jib and the tower, for example in the region of the articulation point of the jib and tower.

In a further preferred embodiment, it is conceivable for the jib articulation part to comprise a connection which is arranged on a site opposite the pivot point. The connection or the connection element makes it possible for the hinged jib articulation part to be fixed in a position in which the front and rear parts thereof are arranged so as to be in parallel, and in particular in parallel with the overall orientation of the jib.

In a further preferred embodiment, it may furthermore be possible for the connection to be released in the inoperative position.

BRIEF DESCRIPTION OF THE DRAWINGS

Further details and advantages of the invention are explained with reference to the embodiments that are shown by way of example in the figures. In said figures.

DESCRIPTION OF THE PREFERRED EMBODIMENTS

Figure 1:
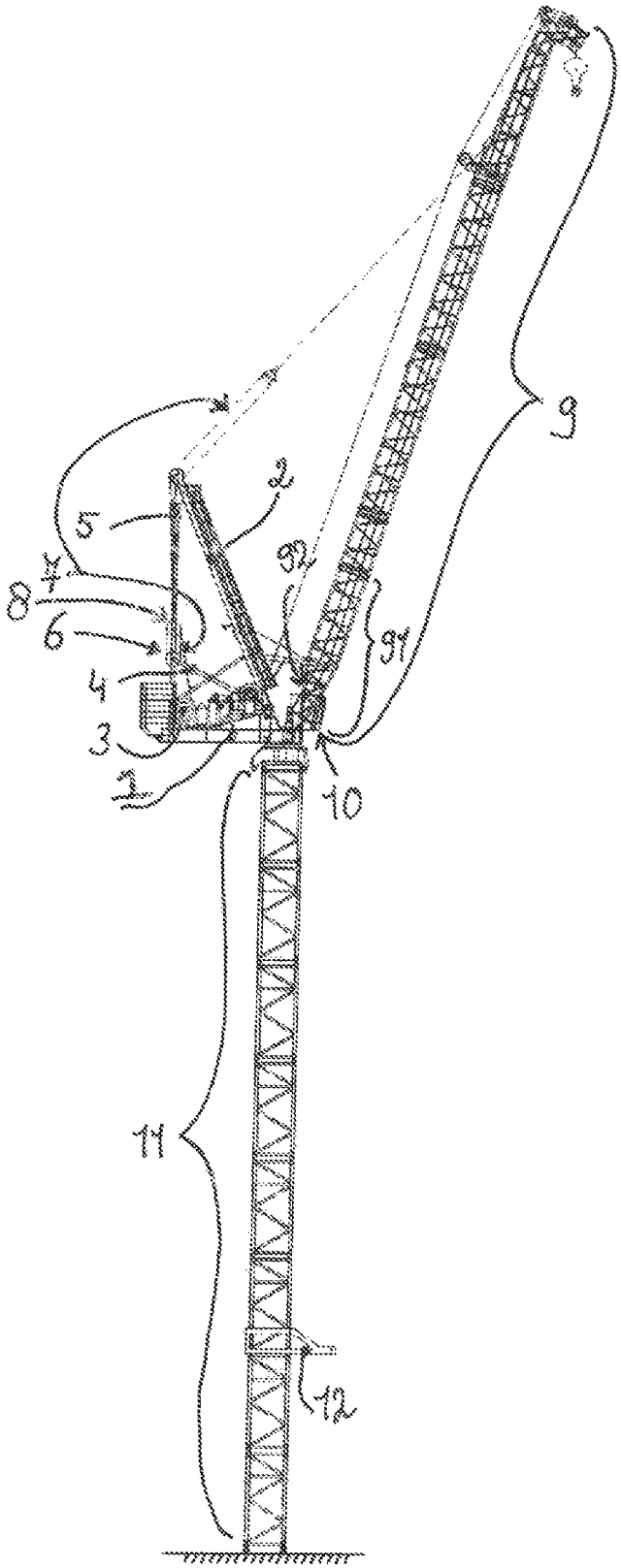
FIG. 1: shows a crane according to the invention in the working position.

FIG. 1 shows a crane according to the invention that is designed as a revolving tower crane, comprising a tower 11 and a jib 9, wherein the jib 9 or the crane is shown in a working position. On the transmission platform 1, an auxiliary support 4 is provided between the jib retaining support 2 and the adjustment winder 3. The auxiliary support 4 is connected to the jib retaining support 2 by means of guy rods 5. In this case, it is also possible to use one single guy rod 5. The connection established by the guy rods 5 may be separable, wherein a controllable actuator may be provided for separating and/or establishing the connection, such that the connection can be manipulated or set by means of a remote controller for example. The guy rods 5 may be permanently coupled to the jib retaining support 2 and releasably coupled to the auxiliary support 4, or vice versa. The adjustment rope 7 is slipped between the auxiliary support 4 and the jib retaining support 2, and furthermore between the jib retaining support 2 and the jib 9, over a cylinder 8.

A stay 10 may be provided at the bottom of the jib articulation part 91. The stay 10 is required for folding or supporting the jib 9. The jib articulation part 91 may be hinged and may correspond to a first portion of the jib 9 via which the jib 9 is connected to the tower 11. A frame 12 may be provided on the tower 11, in which frame the jib 9 can be locked when in the folded position or in the inoperative position. The transmission platform 1 may be arranged in the region of the upper end of the tower 11, as a rotatable platform, and/or may be arranged so as to be rotatable relative to the tower 11 or so as to be rotatable together with the tower 11 relative to an undercarriage (not shown) or another rest.

Figure 2:
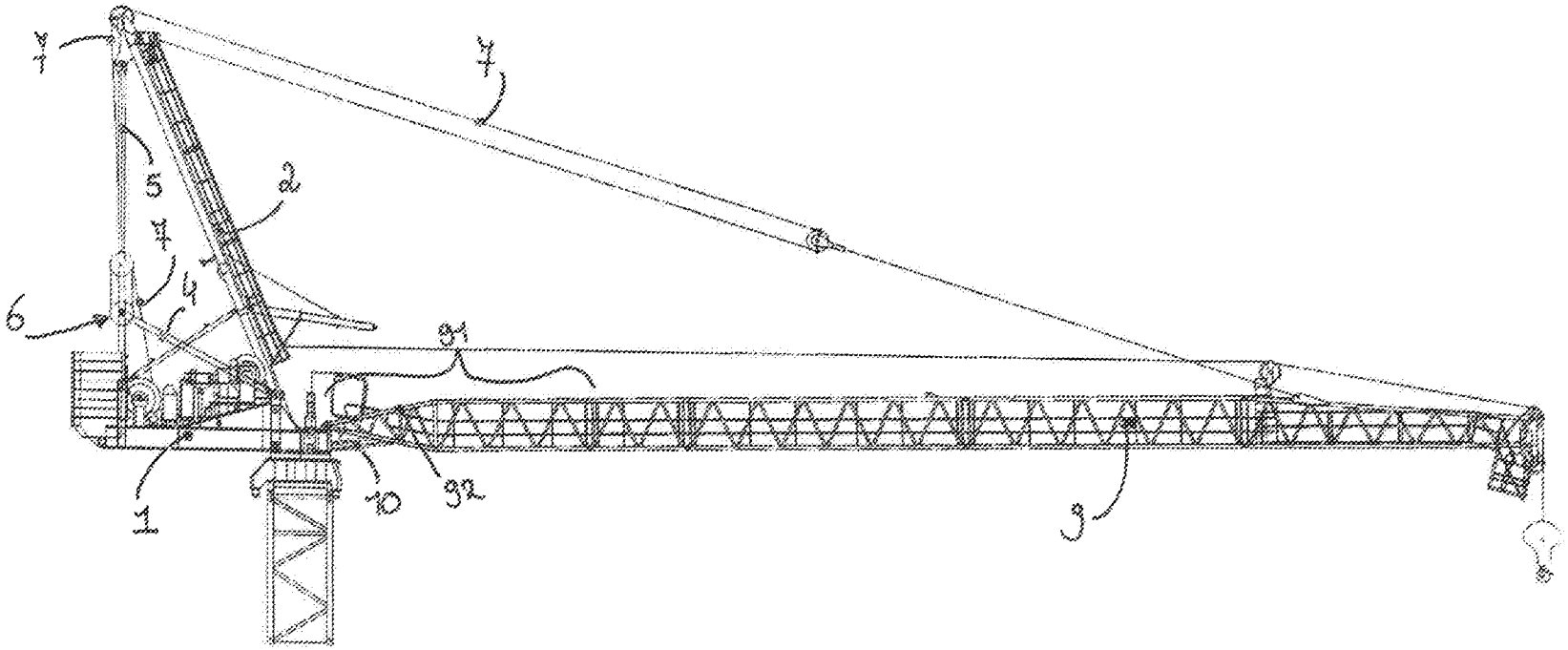
FIG. 2: shows a crane according to the invention in the installation position.

FIG. 2 shows the crane in a position in which the jib 9 has been lowered as far as the horizontal installation position shown here. In the figures, the same reference signs, or reference signs that differ only by apostrophes, denote mutually corresponding features or components. The installation position may also assume an angular position that deviates herefrom. The position or angular position of the jib 9 can be determined or set by means of the length of the adjustment rope 7. In the installation position, the jib 9 is locked to the transmission platform 1, via the stay 10, at the jib articulation part 91. After locking, the adjustment rope 7 can be tensioned. After the adjustment rope 7 has been tensioned, the connection 6 between the auxiliary support 4 and the guy rods 5, and/or between the auxiliary support 4 and the jib retaining support 2, is released. The connection between the supports 2, 4 is now provided in particular only by the adjustment rope 7 and/or is provided by the stay 10. An upper connection 92 in the jib articulation part 91 can also be released. The upper connection 92 in the jib articulation part 91 may be formed as a screw connection and/or as an in particular electronically actuable connection which can be actuated by means of a remote controller for example. The crane is now ready for being folded into the inoperative position shown in FIG. 3.

In the installation position, the guy rod 5 can be arranged so as to be substantially vertical, while the jib retaining support 2 and the guy rod 5 together span an angle of approximately 30°. The spanned angle may, however, also deviate from the specified angle by up to 15°.

Figure 3:
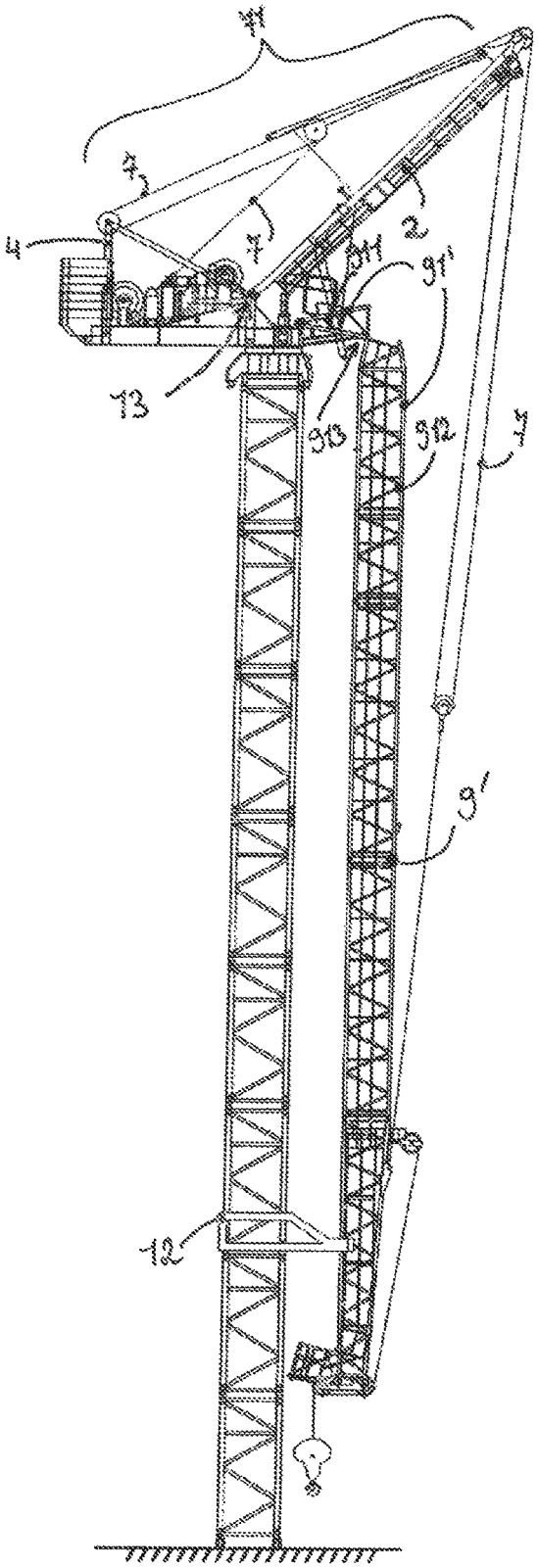
FIG. 3: shows a crane according to the invention in the inoperative position.

As can be seen in FIG. 3, lowering the adjustment rope 7 increases the distance 71 or the angle between the auxiliary support 4 and the jib retaining support 2. Consequently, the jib retaining support 2 rotates about the point 13. As a result, the jib articulation part 91' is folded out. The front 911 and rear 912 part of the jib articulation part 91' are hingedly interconnected at a pivot point 913. The front part 911 may be the part of the jib articulation part 91' that is in particular pivotably and permanently coupled to the transmission platform 1. The jib 9' moves downwards during this process. For the purpose of stabilization, the jib 9' is placed in or on the frame 12. The frame 12 may be designed such that it can be dismantled, and may be installed in further positions on the tower 11.

In order to bring the crane into operation again, the process must be carried out in the reverse sequence. Alternatively, an additional winder may be installed for the purpose of folding, the rope of which winder is slipped between the auxiliary support 4 and the jib retaining support 2. The jib adjustment rope is subjected to less strain as a result.

In the inoperative position shown in FIG. 3, the jib 9' extends in parallel with the tower 11'. Embodiments that deviate therefrom are also conceivable, in which embodiments the jib 9' may be set so as to be angled with respect to the tower 11'. The stay 10 may be separated from jib articulation part 91' and/or from the transmission platform 1, in order to allow for folding of the jib 9'. In this case, an embodiment is preferred in which the stay 10 remains on one of the two components of the jib 9' or the jib articulation part 91' and thus does not have to be completely dismantled.

As can furthermore be seen in FIG. 3, in the inoperative position the jib 9' may be connected to the tower 11' via at least two articulation points. A first articulation point is located in the region of the jib articulation part 91', and connects the jib 9' to the transmission platform 1. A second articulation point is located in the region of the frame 12. The jib 9' and the tower 11' can be fixed to one another by means of the two articulation points. In an embodiment in which the transmission platform 1 is designed so as to be rotatable relative to the tower 11' and the tower 11' itself is arranged so as not to be rotatable with respect to a substructure (not shown) or another base structure of the crane, the two articulation points can prevent rotatability of the crane or of the jib 9' and the transmission platform 1 about a vertical axis.

A third articulation point between the tower 11' and the jib 9' may be defined by the adjustment rope 7, on a side of the jib 9' that is opposite the second articulation point. In the inoperative position, the jib retaining support 2 is arranged so as to be at an angle of approximately 45° with respect to the vertical, while the auxiliary support 4 may be arranged so as to be approximately at right-angles to the jib retaining support 2. In this case, the angle specifications are not to be understood as limiting, and therefore angular deviations of up to 30° from the specified angles are also covered by the inventive concept.

As can furthermore be seen in FIG. 3, in the inoperative position the jib 9' may be positioned in a state that is not shortened. In this case, it is not necessary to at least partly retract or shorten telescopic jibs 9' for example. Foldable jibs 9' or jibs 9' comprising folding tips or folding elements may also be brought into the inoperative position without folding in the corresponding components.

It is conceivable that, in the inoperative position, the jib retaining support 2 may be the component of the crane that protrudes most in the lateral direction and/or upwards in the vertical direction. It may furthermore be possible for the front part 911 of the jib articulation part 91' to be of a length that corresponds to the height of the jib 9' and/or the height of the crane tip. The crane tip may be of a greater height than other portions of the jib 9' which could collide with the tower 11 in the folded state of the crane in FIG. 3.

The front part 911 may therefore function as a spacer which protects the jib 9', hanging down, from contact with at least one part of the remaining crane structure. The front part 911 may have a smaller horizontal extension than the jib retaining support 2. This can ensure that the adjustment rope 7 that is guided over the jib retaining support 2 can also bring about pivoting of the jib 9' in the inoperative position of the crane.

The invention claimed is:

1. Crane, comprising a tower (11) and a jib (9), wherein the jib (9) rests on the tower (11) and is fixed on the tower (11) when the crane is in an inoperative position, and in the inoperative position, the jib (9) is locked against rotation to the tower (11) by a frame (12).

2. Crane according to claim 1, wherein, in the inoperative position, the jib (9) rests on the tower (11) to be parallel.

3. Crane according to claim 1, wherein an auxiliary support (4) is provided between a jib retaining support (2) and an adjustment winder (3) for adjusting the jib (9), which auxiliary support is coupled to the jib retaining support (2), by at least one guy rod (5), when in a working position.

4. Crane according to claim 1, wherein, in an installation position, the jib (9) is coupled to a transmission platform (1), by a stay (10), at a jib articulation part (91).

5. Crane according to claim 4, wherein the frame (12) is coupled to or mounted on the tower (11) at a location underneath and spaced away from the transmission platform (1).

6. Crane according to claim 1, wherein the frame (12) is coupled to or mounted on the tower (11) such that the tower (11) and the jib (9) indirectly contact one another when the jib (9) is locked against rotation.

7. Crane according to claim 1, wherein the frame (12) is separately couplable to the tower (11) at different locations along the tower (11).

8. Crane according to claim 1, wherein the frame (12) has a profile the same as or similar to the tower (11).

9. Crane according to claim 8, wherein the frame (12) has a rectangular cross-section larger than a rectangular cross-section of the tower (11).

10. Crane according to claim 1, wherein the frame (12) is at least partially positioned around the tower (11) to introduce force or torque from the jib (9) into the tower (11).

11. Crane according to claim 10, wherein the frame (12) is entirely positioned around the tower (11).

12. Crane comprising a tower (11) and a jib (9), wherein the jib (9) rests on the tower (11) and is fixed on the tower (11) when the crane is in an inoperative position, an auxiliary support (4) is provided between a jib retaining support (2) and an adjustment winder (3) for adjusting the jib (9), which auxiliary support is coupled to the jib retaining support (2), by at least one guy rod (5), when in a working position, and the auxiliary support (4) and the jib retaining support (2) are uncoupled from one another in the inoperative position.

13. Crane comprising a tower (11) and a jib (9), wherein the jib (9) rests on the tower (11) and is fixed on the tower (11) when the crane is in an inoperative position, in an installation position, the jib (9) is coupled to a transmission platform (1), by a stay (10), at a jib articulation part (91), and in the inoperative position, the stay (10) is uncoupled from the jib articulation part (91) and/or from the transmission platform (1).

14. Crane comprising a tower (11) and a jib (9), wherein the jib (9) rests on the tower (11) and is fixed on the tower (11) when the crane is in an inoperative position, in an installation position, the jib (9) is coupled to a transmission platform (1), by a stay (10), at a jib articulation part (91), the jib articulation part (91) is hinged, and a front part (911) and a rear part (912) of the jib articulation part (91) are rotatably coupled together by a pivot point (913).

15. Crane according to claim 14, wherein the jib articulation part (91) comprises a connection (92) arranged on a side opposite the pivot point (913).

16. Crane according to claim 15, wherein the connection (92) is released in the inoperative position.

* * * * *